United States Patent [19]

Veneziale

[11] Patent Number: 4,558,725

[45] Date of Patent: Dec. 17, 1985

[54] LONGITUDINAL TENDERIZING OF VENEER

[75] Inventor: Lee E. Veneziale, Tyrone, Pa.

[73] Assignee: Westvaco Corporation, New York, N.Y.

[21] Appl. No.: 595,620

[22] Filed: Apr. 2, 1984

[51] Int. Cl.[4] ..... B27M 1/02

[52] U.S. Cl. ..... 144/362; 29/121.7; 100/121; 100/176; 144/2 R; 144/255

[58] Field of Search ..... 100/121, 176; 144/361, 144/362, 255, 2 R; 29/121.6, 121.7, 121 R, 121 A; 144/381

[56] References Cited

U.S. PATENT DOCUMENTS

| | | | |
|---|---|---|---|
| 1,809,681 | 6/1931 | Elmendorf | 144/381 |
| 2,347,820 | 5/1944 | Francek | 144/362 |
| 2,593,863 | 4/1952 | Elmendorf | 144/362 |
| 2,653,890 | 9/1953 | Dosker | 156/219 |
| 2,974,697 | 3/1961 | Elmendorf et al. | 144/362 |
| 3,502,021 | 3/1970 | Kutz | 100/121 |
| 3,618,646 | 11/1971 | Lewis | 100/176 |
| 4,353,296 | 10/1982 | Beucker | 100/176 |

*Primary Examiner*—W. D. Bray

*Attorney, Agent, or Firm*—W. A. Marcontell; R. L. Schmalz

[57] ABSTRACT

As a preparatory step to rigid substrate application, indefinite length strips of wood veneer are tenderized by cross-grain stressing through a roll nip wherein the surface of a steel roll is corrugated with circumferentially extending flutes bearing against the veneer strip and backed by a medium hard rubber roll. Such treatment fractures the natural, transverse or cross-grain fiber in the veneer along longitudinal strip increments of the veneer surface.

14 Claims, 8 Drawing Figures

FIG. 1
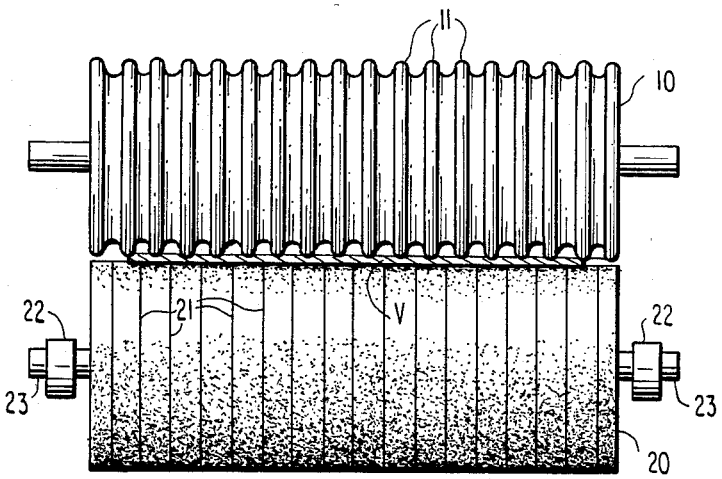
FIG. 2
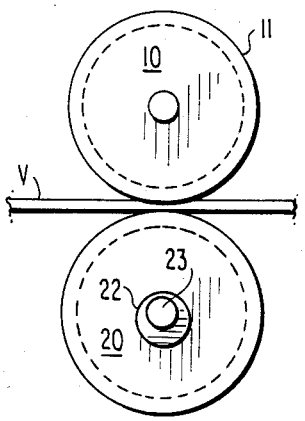
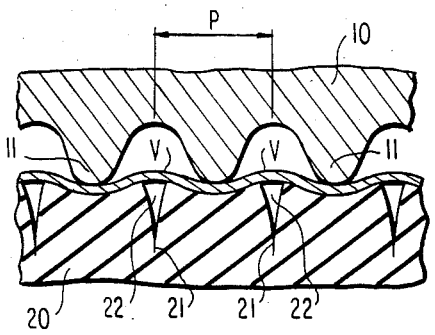
FIG. 3
FIG. 4
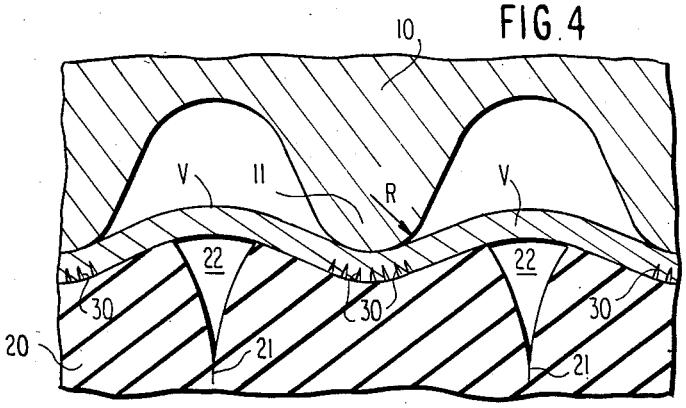
FIG. 5
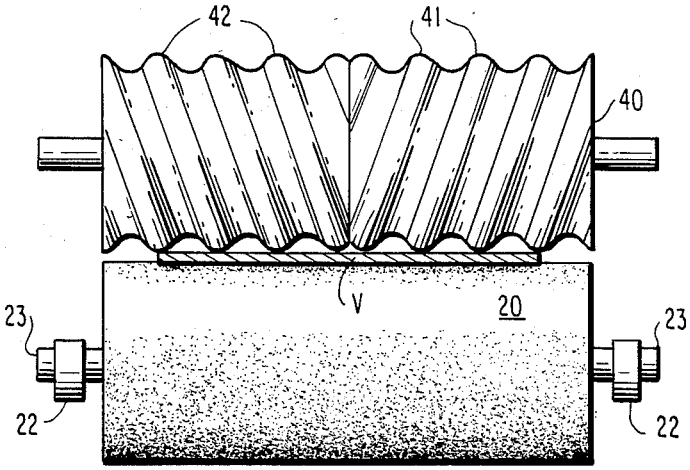

LONGITUDINAL TENDERIZING OF VENEER

BACKGROUND OF THE INVENTION

1. Field of the Invention

The present invention relates to a pretreatment process of wood veneer to enhance the cross-grain pliability of the material.

2. Description of the Prior Art

Tenderizing of wood veneer is a known process for enhancing the cross-grain pliability of the material and eliminating tendencies to cup or curl. Such tenderizing also expands the material's utility as making it applicable to mildly warped and compound curved surfaces.

As a process, tenderizing fractures many, but not all, of the cross-grain wood cells that hold the longitudinal grains together. The longitudinal wood grains which are the dominate source of wood strength and beauty are undisturbed.

Tenderizing technique includes the steps of forcing cross-grain conformity of a wood sheet to the surface of a small radius curve whereby cross-grain rays of wood fiber are broken at the veneer surface. A multiplicity of grain parallel cracks are developed that are usually less than half the sheet thickness in depth. When bonded to a rigid, relatively flat substrate surface, such longitudinal veneer cracks are imperceptible.

A prior art apparatus for veneer tenderizing is disclosed in U.S. Pat. No. 2,974,697 issued to A. Elmendorf et al. on Mar. 14, 1961. The Elmendorf et al. apparatus includes a three line roller nip through which a discrete length of veneer sheet is drawn in the cross-grain direction. The roller nip is parallel to the grain direction. As the sheet is drawn into the nip, it is forced around the curvature of a first roll to fissure the veneer surface on one face and around a second roll to fissure the opposite face. The third roll of the set drives the sheet back into the plane of the feed table to force conformity of the sheet to the second roll curvature.

Although the Elmendorf et al. apparatus successfully tenderizes both faces of a veneer sheet in a single pass, the length of a suitable sheet is necessarily limited by the fixed length of the nip rolls. This is an inherent limitation to use of the machine for tenderizing longer sheets as are shaved by veneer cutting machines.

It is, therefore, an object of the present invention to provide a tenderizing method and machine that will process veneer sheets of great or indefinite length.

Another object of the invention is to provide a veneer tenderizing method and machine that will process a veneer sheet longitudinally with the grain direction.

SUMMARY OF THE INVENTION

These and other objects of the invention are accomplished by one or more pairs of driven, two-roll nips for drawing a veneer sheet longitudinally therebetween. One roll of a pair is provided with a corrugated surface of parallel flutes aligned circumferentially or helically around the roll circumference. Each flute crest is chamfered to a small diameter radius.

The other roll of a nip pair is covered with an elastomeric material of medium Durometer hardness.

As the veneer sheet is drawn longitudinally between a nip roll pair, nip pressure between the corrugated roll flute crests and the elastomer covered backing roll forces the veneer sheet into conformity with a segment of each flute crest profile to fissure a narrow, longitudinal strip in the sheet surface on the side adjacent the elastomer backing roll.

An aligned series of such roll nips having flute crests of successive nips being progressively displaced laterally of the material flow direction will incrementally fissure the entire veneer surface. In the same nip series, nip pairs are provided with inverted positionment of the corrugated roll and backing roll to fissure the opposite sheet face.

DESCRIPTION OF THE DRAWINGS

Relative to the drawings wherein like reference characters designate like or similar elements throughout the several figures:

FIG. 1 is a front elevational view of a roll nip pair in accordance with the present invention;

FIG. 2 is an end elevational view of a roll nip pair in accordance with the present invention;

FIG. 3 is a detail of the invention in nipping contact with a veneer sheet;

FIG. 4 is an enlarged detail of the invention in nipping contact with a veneer sheet;

FIG. 5 is a front elevational view of an alternative embodiment of the invention;

DESCRIPTION OF THE PREFERRED EMBODIMENTS

Figure 6:
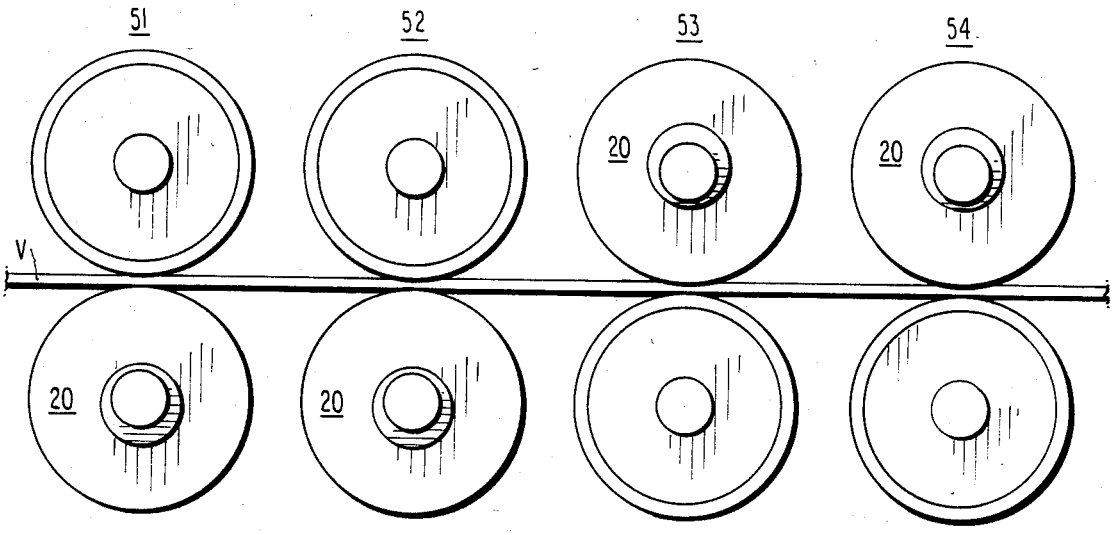
FIG. 6 is an end elevation of a machine line series of roll nips.

The most fundamental and simply executed form of the invention is represented by FIGS. 1 through 4 wherein a steel roll 10 is provided with a parallel plurality of circumferential corrugation flutes 11.

Although there is a wide range of dimensional latitude for construction of corrugation flutes, a periodic spacing P of 5 to 10 mm has been found to be satisfactory on 0.50 mm thicknesses of oak, walnut and cherry. Corresponding with a flute spacing of 5 to 10 mm is a crest chamfer radius R of 2 to 3 mm and a crest to valley amplitude of 2 mm or more. The crest chamfer radius R is the most critical of these dimensions and appears to require less than 5 mm.

Backing roll 20 is elastomer covered with an annulus thickness of 2 to 6 mm. In the same application with 0.50 mm thick oak, walnut and cherry veneer, an elastomer hardness of 70 to 90 Durometer has been satisfactory.

For adjustment of the compressive nip pressure exerted between rolls 10 and 20, eccentrics 22 are provided to receive the roll axle shaft 23 within a mounting frame that is omitted from the drawing for clarity. The shell of roll 20 is independently rotatable about the axle shaft 23 and the eccentric 22 is non-rotatably secured thereto. However, the outer periphery of eccentric 22 is rotatable within respective frame journals. A bellcrank, also not illustrated, is non-rotatively secured to the axle shaft 23 near one end thereof to receive the thrust of a fluid pressure cylinder between the bellcrank arm and the frame. Such thrust rotates the axle and eccentric assembly about the eccentric outer surface axis to shaft the axle 23 toward or away from roll 10 in parallelism therewith.

Although a continuous roll 20 covering of 70 Durometer hardness yields acceptable product, improvements have been gained by slitting the covering circumference to a depth of 1 to 2 mm along lines 21 opposite of the flute 11 valleys. FIGS. 3 and 4 illustrate the effect of such slits 21 to provide lateral yielding at interface spaces. Such lateral yielding permits the elastomer to distort into a more widely accommodating profile opposite of a flute crest 11 thereby opening more longitudinal fissures along the grain of veneer sheet V.

Figure 7:
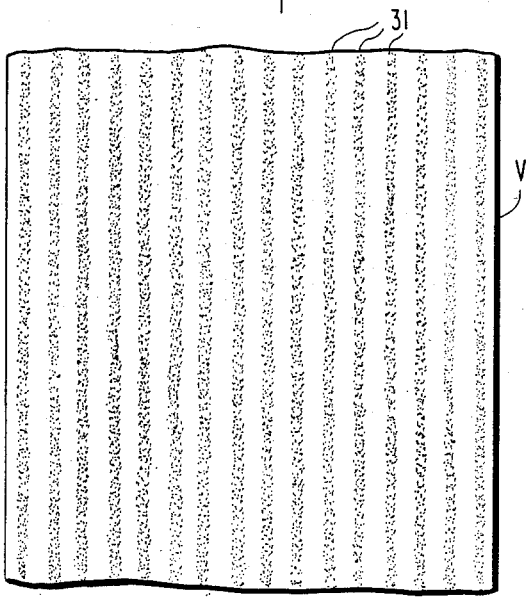
FIG. 7 represents the trace pattern on a veneer sheet made by a single nip pass through the FIG. 1 embodiment.

FIG. 7 illustrates the distress pattern impressed by the FIG. 1 apparatus on a veneer sheet V traveling in the direction of the arrowhead at the top of the figure through a single nip pair between rolls 10 and 20. The shaded strips 31 represent the longitudinal areas of fissuring developed between the crests of flutes 11 and the surface of an elastomer segment between slits 21.

Roll 40 of the FIG. 5 embodiment utilizes a helical pattern to corrugation flutes 41 and 42. Since a helical thread imposes lateral thrust against a nip engagement surface, to balance such thrust a clockwise twist 42 serves one axial half of the roll 40 whereas a counterclockwise twist 41 serves the other half. For this embodiment, a helix angle of 3 to 4 degrees serves both clockwise and counterclockwise helices.

Surface slits such as those 21 used by roll 20 of FIG. 1 may be applied in like manner with the helical configuration, of FIG. 5. However, if a helically slit surface backing roll is used, it will be necessary to index and time the drive of both rolls in a nip pair to keep the helical flute crests in roll 40 continuously aligned between respective helical slits in the backing roll.

Figure 8:
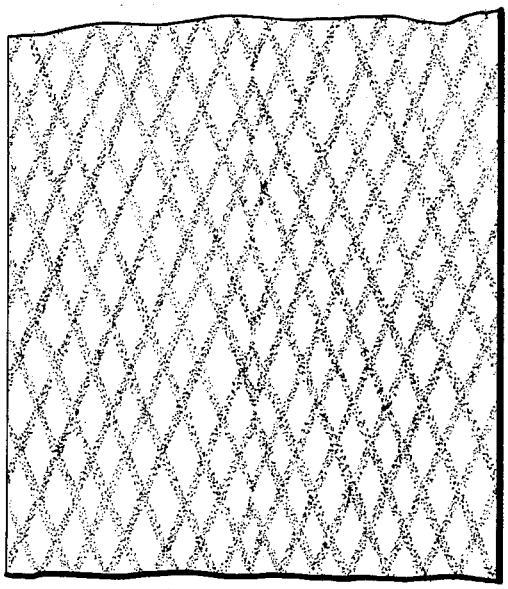
FIG. 8 represents the trace pattern on a veneer sheet made by two coordinated nips of the FIG. 5 embodiment.

The shaded, cross-hatched strip pattern of FIG. 8 is the distress pattern of two successive helical nips such as shown by FIG. 5 where the clockwise helix flute 42 is on the left side of the material flow axis for the first nip and on the right side for the second nip.

FIG. 6 is representative of a full machine line for implementing the invention with four nips in series. In the first two nips, 51 and 52, the veneer sheet V is distressed on the side adjacent to the backing rolls 20 which is the bottom side. In the latter two nips, 53 and 54, the veneer surface is distressed on the top side.

If the corrugated roll of the first nip pair 51 is of the circumferential flute embodiment of FIG. 1, it will impose a distress pattern on the bottom side of sheet V such as that of FIG. 7. In the second nip 52, the distress pattern will be the same but laterally offset relative to the first nip impressions so as to distress the clear areas of FIG. 7 in between the previously distressed shaded areas.

The same sequence and offset is repeated by nip pairs 53 and 54 on the top side of sheet V to completely tenderize the entire surface area of the sheet, top and bottom, without limitation as to length.

Extremely thin veneers such as the 0.5 mm sheet example given herein are normally reinforced with a paper or fabric substrate adhered to back face thereof prior to tenderizing. The presence of such thin, flexible substrates has no apparent negative effect on the resultant product.

Having fully disclosed my invention and the preferred embodiments thereof, obvious modifications or alterations will readily occur to those of ordinary skill in the art.

For my invention, therefore, I claim:

1. A method of tenderizing a sheet of wood veneer comprising the steps of:

a. drawing a sheet of veneer along a longitudinal direction parallel with the grain of said sheet into a first nip between an elastomer surface backing roll and a corrugated roll having corrugation flutes extending predominately around the surface of said corrugated roll to distress longitudinally extending first strip areas of said sheet on the side thereof adjacent said backing roll and opposite of sheet contact areas by flute crests;

b. drawing said sheet along said longitudinal direction into a second nip between an elastomer surface backing roll and a corrugated roll whereby contact points of flute crests corresponding to said second nip corrugated roll distress second strip areas parallel with but laterally offset from said first strip areas; and, c. drawing said sheet along said longitudinal direction into additional nips between an elastomer surface backing roll and a corrugated roll to distress additional, laterally offset and parallel strip areas until substantially the entire surface of said sheet has been distressed.

2. A method as described by claim 1 wherein said corrugated roll flutes extend circumferentially around said corrugated roll surface to distress longitudinal strip areas of said sheet parallel with the grain of said sheet.

3. A method as described by claim 1 wherein said corrugated roll flutes extend helically around said corrugated roll surface to distress strip areas extending diagonally of the grain direction of said sheet.

4. An apparatus for tenderizing a sheet of wood veneer comprising:

an elastomer surface backing roll disposed for parallel axis rotation with a corrugated hard surface roll having corrugation flutes of less than 5 mm crest radius extending predominantly around the surface of said corrugated roll, the axis of one of said rolls being positionally adjustable relative to the axis of said other roll whereby a sheet of wood veneer may be nip loaded between said rolls and one of said rolls being rotationally driven to draw said sheet into said nip.

5. An apparatus as described by claim 4 wherein said corrugation flutes extend circumferentially around the surface of said corrugated roll.

6. An apparatus as described by claim 4 wherein said corrugation flutes extend helically around the surface of said corrugated roll.

7. An apparatus as described by claim 6 wherein said helical corrugation flutes comprise two helical leads of opposite hand twist.

8. An apparatus as described by claim 4 wherein said elastomer surface backing roll comprises a plurality of circular segments delineated by circumferential slits in said backing roll surface, said slits being aligned in opposition to flute valleys respective to said corrugated roll.

9. An apparatus as described by claim 4 wherein said elastomer surface backing roll comprises an annular roll covering of elastomer material approximately 2 to 6 mm thick and 70 to 90 Durometer hardness.

10. An apparatus for tenderizing a sheet of wood veneer comprising:

a plurality of driven roll nips in series alignment along a veneer sheet process line for drawing a veneer sheet between rotatively converging surfaces of two rolls respective to a single nip, one of said two rolls respective to each nip having an elastomer surface and the other roll having a corrugated hard surface, said corrugated roll surface comprising corrugation flutes extending predominantly around said roll, flute crest areas of the corrugated roll respective to each nip being aligned and timed to engage different surface areas of a veneer sheet passing successively through said plurality of nips and means to displace one roll of a nip relative to the other in parallel axis translation to compressively load opposite face surfaces of said veneer sheet between said flute crests and said elastomer surface.

11. An apparatus as described by claim 10 wherein said corrugated roll flutes extend circumferentially around said roll.

12. An apparatus as described by claim 11 wherein said elastomer surface roll is axially divided into segments separated by radial slits in the surface of said roll extending circumferentially thereabout, each of said slits being planar aligned between the planes of adjacent flute crests on said corrugated roll.

13. An apparatus as described by claim 10 wherein said corrugated roll flutes extend helically around said roll.

14. An apparatus as described by claim 13 wherein each corrugated roll comprises two flute helices of opposite twist orientation emanating from the center plane between opposite ends of said roll.

* * * * *